United States Patent [19]

Holum

[11] 4,015,863

[45] Apr. 5, 1977

[54] EASEL BINDER

[75] Inventor: Edward T. Holum, Northbrook, Ill.

[73] Assignee: Holum & Sons Co., Inc., Berkeley, Ill.

[22] Filed: July 17, 1975

[21] Appl. No.: 596,614

[52] U.S. Cl. ..... 281/33

[51] Int. Cl.[2] ..... A47B 23/00; B42D 3/00

[58] Field of Search ..... 281/33, 37.5; 40/152.1

[56] References Cited

UNITED STATES PATENTS

| | | | |
|---|---|---|---|
| 2,883,209 | 4/1959 | Erickson | 281/33 |
| 3,019,486 | 2/1962 | Stinson | 281/37 X |
| 3,199,897 | 8/1965 | Wolfe | 281/33 |
| 3,224,792 | 12/1965 | Vernon | 281/33 |

*Primary Examiner*—Jerome Schnall
*Attorney, Agent, or Firm*—Olson, Trexler, Wolters, Bushnell & Fosse, Ltd.

[57] ABSTRACT

An easel notebook binder having a cover with an articulated portion adapted to be folded to an easel providing position includes a one-piece flexible plastic member secured to the underside of a notepaper retaining ring mechanism and providing a tab which is foldable for releasably securing the articulated cover portion in the easel providing position.

2 Claims, 4 Drawing Figures

FIG.2

FIG.1
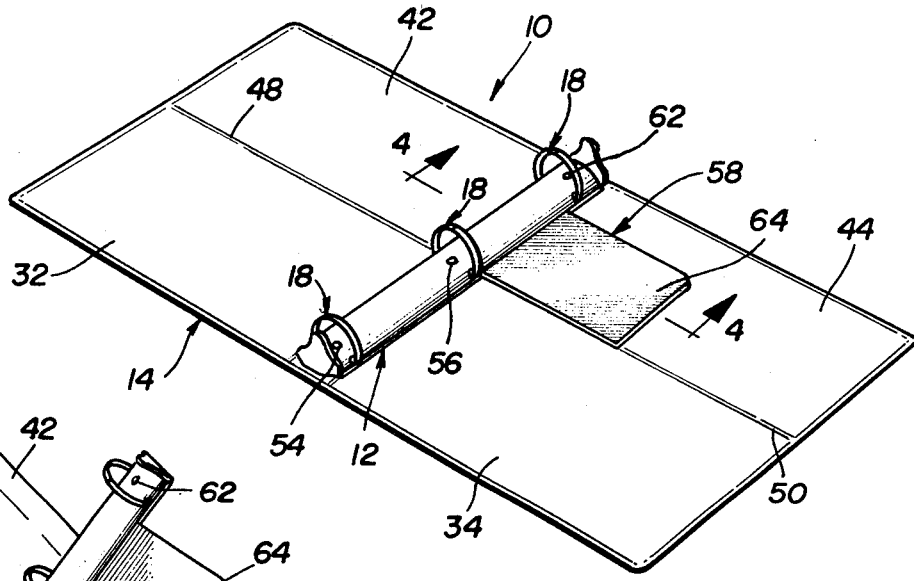
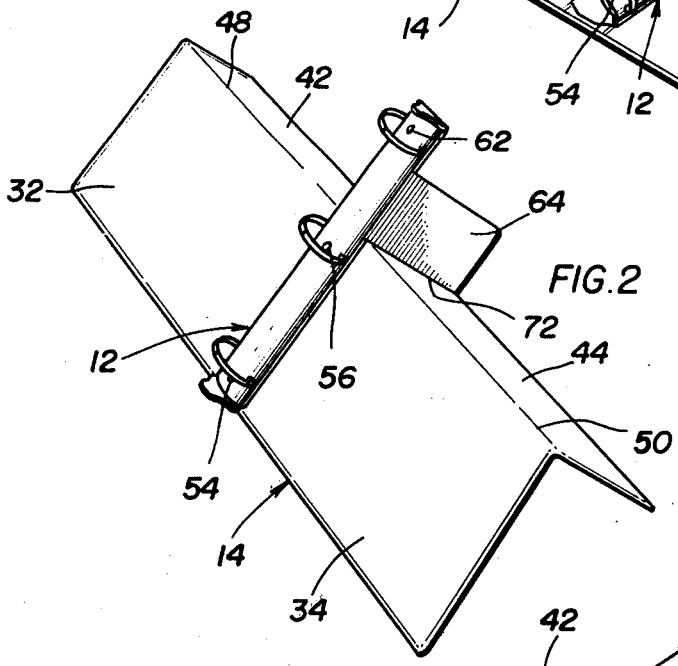
FIG.2
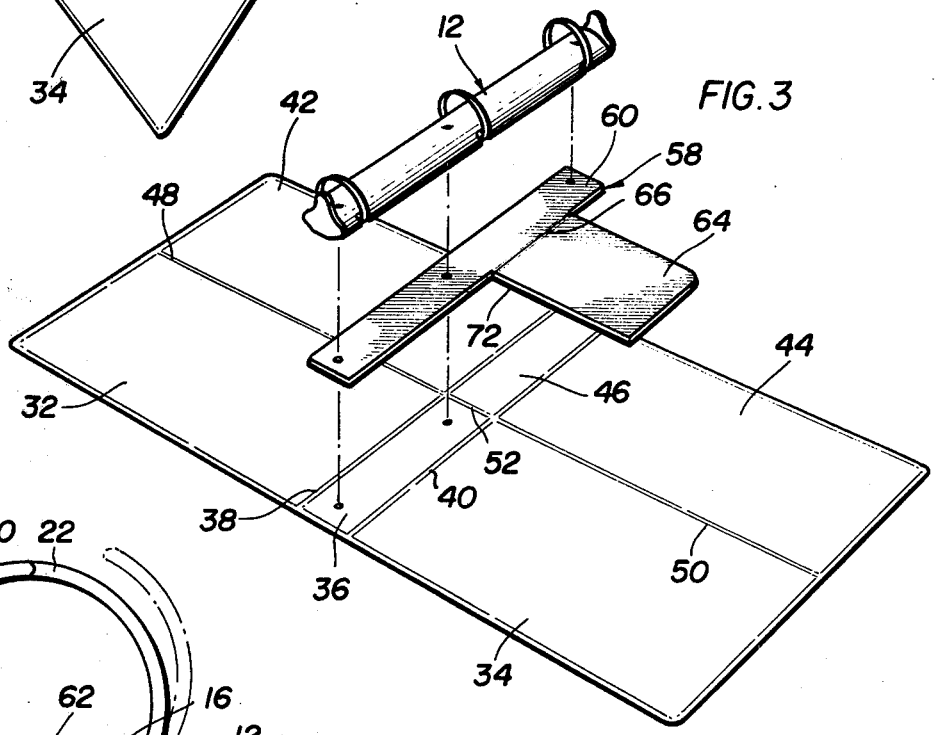
FIG.3
FIG.4
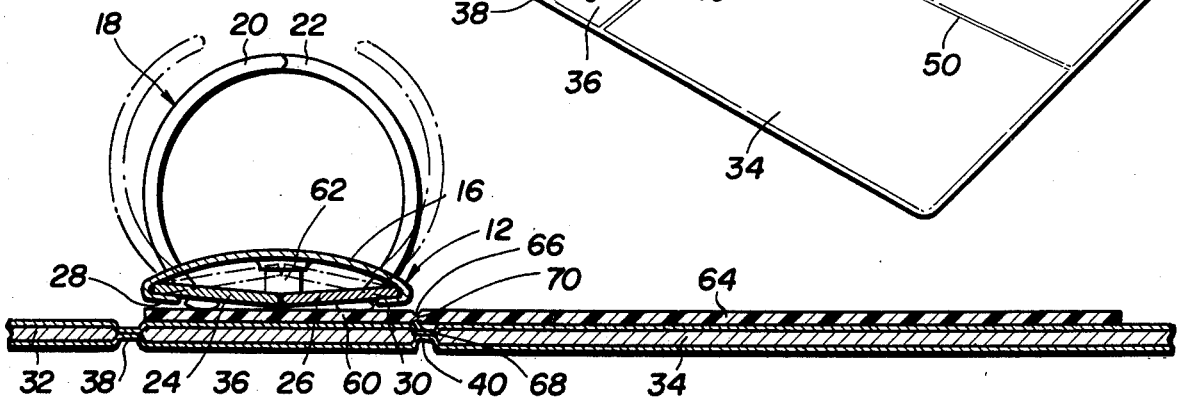

EASEL BINDER

The present invention relates to a novel notebook type binder structure, and more specifically to a novel easel binder.

BACKGROUND OF THE INVENTION

Easel binders have heretofore been suggested which include a snap ring mechanism for receiving a plurality of notebook pages and the like and a cover having top and back members at least one of which is formed with an articulated portion adapted to be folded downwardly to act as a support for holding the binder in an inclined or easel providing position. In order to retain the articulated portion in the easel providing position, such heretofore suggested binder structures have further included a metal tab pivotally connected to the binder by means of a sheet metal hinge having interleaved portions and a hinge pin. Such structures are relatively expensive and furthermore it has been found that the sheet metal hinge structure may be relatively easily bent or broken.

SUMMARY OF THE INVENTION

It is an important object of the present invention to provide a novel easel binder which is relatively inexpensive and which at the same time is of rugged long-lasting construction.

Still another important object of the present invention is to provide a novel easel binder having articulated cover means foldable to an easel providing position and a shiftable retainer for securing the articulated cover portion in the easel providing position, which retainer is relatively resistant to damage, is easy to operate, and is economical.

A still further object of the present invention is to provide a novel easel binder of the above-described type wherein the articulated cover is such as to expose a portion of the ring mechanism when folded to the easel providing position, which binder includes means for covering the otherwise exposed portion of the ring structure for enhancing the appearance of the unit and preventing inadvertent injury to the user.

Another more specific object of the present invention is to provide a novel easel binder of the above-described type including a central snap ring mechanism for receiving notebook pages and the like, which mechanism includes an elongated frame member, a plurality of releasably openable ring units spaced therealong, a cover secured to the back side of the frame member, which cover has front and back panels and a connecting panel which underlies the frame member, each of which panels has an articulated portion adapted to be folded to an angular position for providing an easel support and a combined one-piece guard and retainer having a base portion disposed between the frame member and connecting cover panel for covering the underside of the ring mechanism when the articulated portions of the cover are folded to the easel providing position, and a flap integrally articulated to said base portion and adapted to be folded for releasably retaining said articulated cover portions in the easel providing position.

Other objects and advantages of the present invention will become apparent from the following description and the accompanying drawings.

SHORT DESCRIPTION OF DRAWINGS

FIG. 1 is a perspective view showing an easel binder incorporating features of the present invention with cover panels thereof in a normal open flat position;

FIG. 2 is a perspective view of the easel binder shown in FIG. 1 with articulated portions of the cover folded downwardly to an easel providing position;

FIG. 3 is an exploded perspective view of an easel structure incorporating the features of the present invention; and FIG. 4 is an enlarged fragmentary sectional view taken generally along line 4—4 in FIG. 1.

DETAILED DESCRIPTION

Referring now more specifically to the drawings wherein like parts are designated by the same numerals throughout the various figures, an easel binder 10 incorporating features of the present invention includes a ring mechanism 12 and a cover 14. The ring mechanism shown for purposes of illustrating the present invention is a three-ring unit which may be of any known construction. However, it is to be understood that features of the present invention may be incorporated in binders having a different number of rings or having any other known mechanism for receiving and retaining notebook pages or any other sheets to be included in the binder.

In the embodiment shown, the ring mechanism 12 has an elongated frame member 16 preferably of concavo-convex transverse cross-section as shown in FIG. 4 and presenting a smooth upper surface. Split ring assemblies 18 are spaced along the frame member and comprise complementary ring portions 20 and 22 respectively having inner ends projecting through apertures in the frame member and fixed to complementary flexure spring elements 24 and 26 secured along the underside of the frame member. In-turned flanges 28 and 30 are provided along opposite margins of the frame member 16 for retaining the flexure spring elements. As shown in FIG. 4, the complementary ring elements 20 and 22 and the flexure spring elements are adapted to be snapped between the solid line position and the broken line position for permitting pages to be assembled with or removed from the ring mechanism.

The cover 14 comprises a normally planar top panel 32, a normally planar bottom panel 34 and a connecting panel 36 therebetween. The cover may be formed from any suitable paper, board, plastic or other sheet material or may be of a composite construction as indicated in FIG. 4. In any event, the connecting portion 36 has transverse and longitudinal dimensions so that it is substantially coextensive with the frame member 16 of the ring mechanism and the top and back cover panels are integrally articulated to or otherwise hingedly connected to the intermediate panel 36 by hinge means or along scored bend lines 38 and 40.

The top and back cover panels 32 and 34 and the connecting panel 36 respectively include articulated portions 42, 44 and 46 joined to the remainder of the panels along scored bend lines or hinge means 48, 50 and 52.

As shown in FIGS. 1 and 3, the articulated portions of the cover panels are normally in the same plane as the remaining portions of the panels. Thus, the cover may be readily moved from the open position to a closed position by folding the top and back panels along the hinge means 38 and 40 in the usual manner.

When it is desired to utilize the binder as an easel, the articulated portions 42, 44 and 46 are manually folded or bent to a position extending at an angle from the remaining portions of the panels in order to provide a support engageable with a tabletop or the like for holding the binder in an inclined position as shown in FIG. 2. Preferably, the articulated portions 42, 44 and 46 are folded so as to extend at an angle of about 90° with respect to the remaining portions of the cover panels. Furthermore, the bend lines 48, 50 and 52 are near midportions of the cover panels but preferably slightly closer to the upper edges of the panels than the lower edges so that when the binder is in the easel supporting position shown in FIG. 2, the lower inclined portions of the cover panels will be disposed at an angle of slightly less than 45° with respect to the horizontal.

The cover is secured across the underside of the ring mechanism by a pair of rivets 54 and 56 or other suitable fastening means. In the embodiment shown, the rivets extend through the frame member 16 and the connecting panel 36 of the cover. While rivet 54 is located toward the lower end of the ring mechanism, rivet 56 is located toward the midportion of the ring mechanism and, in any event, below the hinge or bend lines 48, 50 and 52 in the cover panels so that the articulated cover portions are free to be folded as described above.

In accordance with a feature of the present invention, the binder structure is provided with a novel combined guard and releasable retainer flap member 58. As shown best in FIG. 3, the member 58 is provided with a base portion 60 substantially coextensive in transverse and longitudinal dimensions with the frame member 16. The base portion 60 is positioned between the ring mechanism and the intermediate connecting panel 36 of the cover and is secured in position by the aforementioned rivets or fasteners 54 and 56. In addition, it is to be noted that an upper end of the base portion 60 is secured beneath the ring mechanism by an additional rivet or fastener 62. With this arrangement, it will be appreciated that the underside of the ring mechanism will always be completely enclosed and covered. In other words, in the absence of the base portion 60, at least a part of the underside of the ring mechanism would be exposed when the articulated portions of the cover panels are folded to the easel providing position shown in FIG. 2. Such an exposure is not only unsightly, but also creates a possibility of injury to a user who might inadvertently grasp the exposed end of the ring mechanism and be pinched or cut by exposed edges of the in-turned flanges 28 and 30 or the flexure spring elements 24 and 26.

It is important to note that the member 58 also includes a retainer tab or flap 64 extending laterally from one longitudinal margin of and normally in the plane of the base portion 60 as shown in FIG. 3. The flap 64 is integrally articulated to or hingedly connected to the base portion so that it may be folded from the planar position shown in FIG. 3 to an angular downwardly extending position shown in FIG. 2 as described more in detail below. Score lines 66 and 68 are provided in upper and lower surfaces of the member 58 so as to define a relatively flexible junction or hinge connection 70 between the base portion 60 and the flap 64. The member 58 is formed from a sheet material blank of tough resilient plastic material such as polyethylene which is such that the relatively thin hinge junction 70 may be repeatedly flexed between the positions shown in FIGS. 2 and 3 without cracking or breaking. Furthermore, the tough plastic material is otherwise of such thickness that the flap 64 is stiff and rugged and highly resistant to unwanted bending or breaking.

As will be apparent from the above-described description, when it is desired to use the binder as an easel, the top and back cover panels will first be unfolded from a normally closed generally parallel position (not shown) to the open position shown in FIG. 1. Then the articulated panel portions 42, 44 and 46 are manually folded downwardly along the scored hinge or bend lines 48, 50 and 52. As will be understood, the inherent resiliency of the board, paper, plastic or other material from which the cover is formed normally tends to bias the articulated panels from the easel providing position of FIG. 2 back toward the planar position of FIG. 1. In order to releasably lock the articulated portions in the downwardly inclined position, the retainer flap 64 is manually bent along the hinge line 70 from the planar position shown in FIGS. 1 and 3 to a downwardly projecting position as shown in FIG. 2 for overlying and engaging the articulated panel portion 44 and thus locking the panel portion in the easel providing position. It will be noted that the retainer flap or tab 64 is located so that a panel engaging edge 72 thereof is substantially in alignment with the fold line 50. Furthermore, the edge 72 extends substantially at right angles from the longitudinal edge of the base portion 60. Thus, when the tab or flap 64 is moved to the position shown in FIG. 2, the edge 72 engages the panel portion 44 for locking it along with the interconnected panel portions 46 and 42 in the easel providing position. The inherent resiliency in the sheet material from which the cover is made provides a spring action urging the articulated panel portion firmly against the edge 72 so as to bind the tab or flap 64 against inadvertent slippage. At the same time, the resiliency of the plastic material from which the member 58 is formed provides a spring action tending to bias the flap 64 from the depending position shown in FIG. 2 back toward the planar position shown in FIGS. 1 and 3 to facilitate intentional manual manipulation of the flap back to the planar or horizontal position when it is desired to close the binder.

While a preferred embodiment of the present invention has been shown and described herein, it is obvious that many structural details may be changed without departing from the spirit and scope of the appended claims.

The invention is claimed as follows:

1. An easel binder comprising a retainer mechanism for receiving and retaining items such as pages to be enclosed within the binder, said retainer mechanism including an elongated frame member mounting the inner ends of spaced spring flexured split ring assembles, cover means including front and back panels connected to an intermediate connecting panel, said intermediate connecting panel underlying said frame member, each of said cover means panels including an articulated portion joined to the remainder of the panels along bend lines located intermediate opposite lower and upper ends of said elongated frame member and extending transversely of said elongated frame member, said articulated portions being foldable along an apical portion from a first generally planar position to a second angularly extending position for supporting the binder in an easel providing position, a one-piece resilient sheet material member including an elongated planar base portion between said intermediate panel and said elongated frame member and substantially coextensive with both said panel and said frame member for entirely underlying said elongated frame member and the inner ends of said split ring assemblies, said one-piece resilient sheet material member including a flap portion normally disposed in the plane of said planar base portion and extending laterally from said planar base portion when said articulated panel portions are in said generally planar position, said flap portion being integrally articulated to a longitudinally extending margin of said base portion along a resilient junction located closely adjacent said apical portion between said upper end of said frame member and an adjacent transversely extending bend line and serving as the sole connecting means with said base portion independently of connection with the overlying frame member for permissive movement of said flap portion between said generally planar position and an angularly extending articulated cover portion retaining position, said sheet material being a tough resilient plastic material of predetermined thickness, and score means in said sheet material member at said junction for defining a relatively thin, easily bendable hinge therebetween, fastener means extending between and fixedly securing said remaining portion of the intermediate cover panel and said base portion with respect to said frame member, and additional fastener means located toward said upper end of the frame member and extending between and securing only said base portion and said frame member.

2. An easel binder as defined in claim 1, wherein said score means are along opposite sides of said sheet material member at said junction.

* * * * *